US005785183A

United States Patent [19]

Rejeté

[11] Patent Number: 5,785,183

[45] Date of Patent: Jul. 28, 1998

[54] DISPLAY UNIT AND ARRANGEMENT OF THIS DISPLAY UNIT IN PREMISES FURNISHED WITH AN OPENING

[76] Inventor: Alain Rejeté, 16, rue Jean Ferrandi, 75006 Paris, France

[21] Appl. No.: 569,209

[22] PCT Filed: Jun. 10, 1994

[86] PCT No.: PCT/FR94/00694

§ 371 Date: Feb. 1, 1996

§ 102(e) Date: Feb. 1, 1996

[87] PCT Pub. No.: WO95/00055

PCT Pub. Date: Jan. 5, 1995

[30] Foreign Application Priority Data

Jun. 17, 1993 [FR] France ..... 93 07329

[51] Int. Cl.[6] ..... A47F 3/08

[52] U.S. Cl. ..... 211/1.51; 211/1.53; 312/266

[58] Field of Search ..... 211/1.51, 1.53, 211/1.55, 1.56; 322/266; 414/267, 331

[56] References Cited

U.S. PATENT DOCUMENTS

| | | | |
|---|---|---|---|
| 264,748 | 9/1882 | Potts | 312/266 X |
| 393,898 | 12/1888 | Hamburg et al. | 211/1.53 |
| 806,277 | 12/1905 | McKee | 312/266 X |
| 1,145,264 | 7/1915 | Pflug | 312/266 |
| 1,229,447 | 6/1917 | Hammond | 312/266 X |
| 1,899,567 | 2/1933 | Haug . | |
| 2,019,083 | 10/1935 | Loftin | 312/266 X |
| 2,240,960 | 5/1941 | Sherwood | 312/266 |
| 3,038,773 | 6/1962 | Vasbinder, Sr. | 312/266 |
| 3,537,768 | 11/1970 | Anders | 312/266 X |
| 3,857,623 | 12/1974 | Schneller | 312/266 |
| 4,915,461 | 4/1990 | Kingsborough et al. | 312/266 X |
| 5,228,763 | 7/1993 | Gingold | 312/266 |

FOREIGN PATENT DOCUMENTS

| | | |
|---|---|---|
| 199925 | 9/1938 | Switzerland . |
| WO 91/13223 | 9/1991 | WIPO . |

*Primary Examiner*—Ramon O. Ramirez
*Assistant Examiner*—Anita M. King
*Attorney, Agent, or Firm*—Young & Thompson

[57] ABSTRACT

The display unit comprises a main frame (16) which is hingedly mounted about a shaft (30) with a horizontal axis, and provided with at least one shelf supported by a horizontal pin (30, 32) mounted pivoting about its axis on two uprights (18) of the main frame (16), means (50, 52; 50A) for displacing the main frame (16) between a reduced ground space position and a display position, and means (44) for stabilizing the angular position of each shelf (24) independently of the position of the main frame (16). According to the arrangement, the display unit is displaceable through the opening between a position inside the room, when the main frame (16) is in a reduced ground space position and a position at least partially outside the room, when the main frame (16) is in a display position.

16 Claims, 9 Drawing Sheets

DISPLAY UNIT AND ARRANGEMENT OF THIS DISPLAY UNIT IN PREMISES FURNISHED WITH AN OPENING

FIELD OF THE INVENTION

The present invention relates to an improved display unit and an arrangement of this display unit in premises furnished with an opening.

It applies in particular to shelves in shops selling for example flowers, sweets, clothes, etc.

BACKGROUND OF THE INVENTION

Conventionally, the shelves are placed outside, in front of the shop. When the shop closes, the shelves have to be stored at the back of the shop, this requiring daily laborious manhandling of the display units and merchandise placed thereon.

SUMMARY OF THE INVENTION

The aim of the invention is in particular to do away with the laborious manhandling related to the erecting and laying out of the shelves, and to do so by proposing a display unit which provides for the very flexible display of the merchandise during shop opening periods and storage of this merchandise during periods when the shop is closed while still displaying them commercially through a window.

For this purpose the subject of the invention is a display unit characterized in that it comprises a main chassis fitted articulated about a shaft with horizontal axis, furnished with at least one shelf carried by a horizontal spindle fitted pivoting about its axis to two uprights of the main chassis, means for the movement of the main chassis between a position of confined floor space and a display position, and means for stabilizing the angular position of each shelf independently of the position of the main chassis.

According to characteristics of various embodiments of the invention:

- the articulation shaft is rotationally immobilized with respect to its axis, and the means for the angular stabilization of each shelf comprise means for coupling the corresponding shelf-carrying spindle with the articulation shaft;
- the articulation shaft forms a shelf-carrying spindle;
- the display unit includes at least one shelf-carrying spindle whose means of coupling with the articulation shaft comprise at least one chain or belt for coupling two wheels, one secured to the shelf-carrying spindle and the other to the articulation shaft;
- the display unit includes at least one secondary chassis secured to a shelf-carrying spindle, comprising two vertically and horizontally mutually offset shelves;
- the means for the movement of the main chassis comprise means for swinging this chassis about its articulation shaft;
- the means for swinging the main chassis comprise at least one owing arm furnished with a first end fitted pivoting about an axis parallel to the articulation shaft and with a second end fitted sliding in a glideway secured to the main chassis;
- the means for the movement of the main chassis moreover comprise means for the vertical movement of the articulation shaft, these means being coupled with the swinging means;
- the means for the vertical movement of the articulation shaft comprise at least one component with nut secured to the articulation shaft cooperating by screwing with a vertical threaded drive rod;
- the display unit includes two fixed lateral frames located on either side of the uprights of the main chassis, each frame carrying a swing arm whose sliding end is furnished with an articulated pad cooperating with a glideway-forming member secured to a corresponding upright of the main chassis, a threaded drive rod cooperating by screwing with a component with nut secured to a corresponding end of the articulation shaft, means for coupling the swing arm and the threaded drive rod, the threaded drive rods of the frames being coupled to at least one drive motor or to manual drive means;
- the means for the vertical movement of the articulation shaft comprise at least one set of linkages delimiting an articulated parallelogram including two first parallel sides, one of which is fixed and the other of which is secured to the articulation shaft while being movable by the pivoting of the other two parallel sides of the parallelogram;
- the display unit comprises two fixed lateral frames located on either side of the uprights of the main chassis, each frame carrying a swing arm whose sliding end is furnished with an articulated pad cooperating with a glideway-forming member secured to a corresponding upright of the main chassis, a set of linkages forming an articulated parallelogram whose mobile aide parallel to the fixed side is secured to a corresponding end of the articulation shaft, means for coupling the swing arm and a pivoting side of the parallelogram, the swing arms of the frames being coupled to at least one drive motor or to manual drive means;
- the display unit includes elastic means opposing the effects of the weight of the main chassis and of its loading during its movements;
- the elastic means opposing the effects of the weight of the main chassis comprise a spring leaf, located in each of the frames, furnished with a first fixed end and with a second end sliding along the corresponding swing arm while being pressed elastically against the latter;
- the display unit includes elastic means for assisting the movement of the articulation shaft towards its topmost position;
- the elastic assisting means comprise a tension spring located in each of the frames, and furnished with an end connected to the corresponding component with nut;
- the elastic assisting means comprise a compression spring located in each frame, and furnished with an end cooperating with a pivoting side of the corresponding parallelogram.

The subject of the invention is also an arrangement of a display unit such as defined above in premises including a substantially vertical opening, characterized in that the display unit can be moved through the opening between a position inside the premises, when the main chassis is in the position of confined floor space, and a position at least partly outside the premises when the main chassis is in the display position.

According to other characteristics of this arrangement:

- the opening of the premises can be shut off by a retractable window;
- the retractable window comprises two panes, of generally rectangular shape, whose adjacent edges are articulated together about a horizontal axis and whose opposite edges are located in the plane of the opening, in such a way that one of these edges is articulated about a horizontal fixed axis, in the vicinity of the upper edge of the opening, and the other of these edges can be translated vertically with respect to the fixed articulation axis.

BRIEF DESCRIPTION OF THE DRAWINGS

Example embodiments of the invention will be described below whilst referring to the appended drawings in which.

DESCRIPTION OF THE PREFERRED EMBODIMENTS

Figure 1:
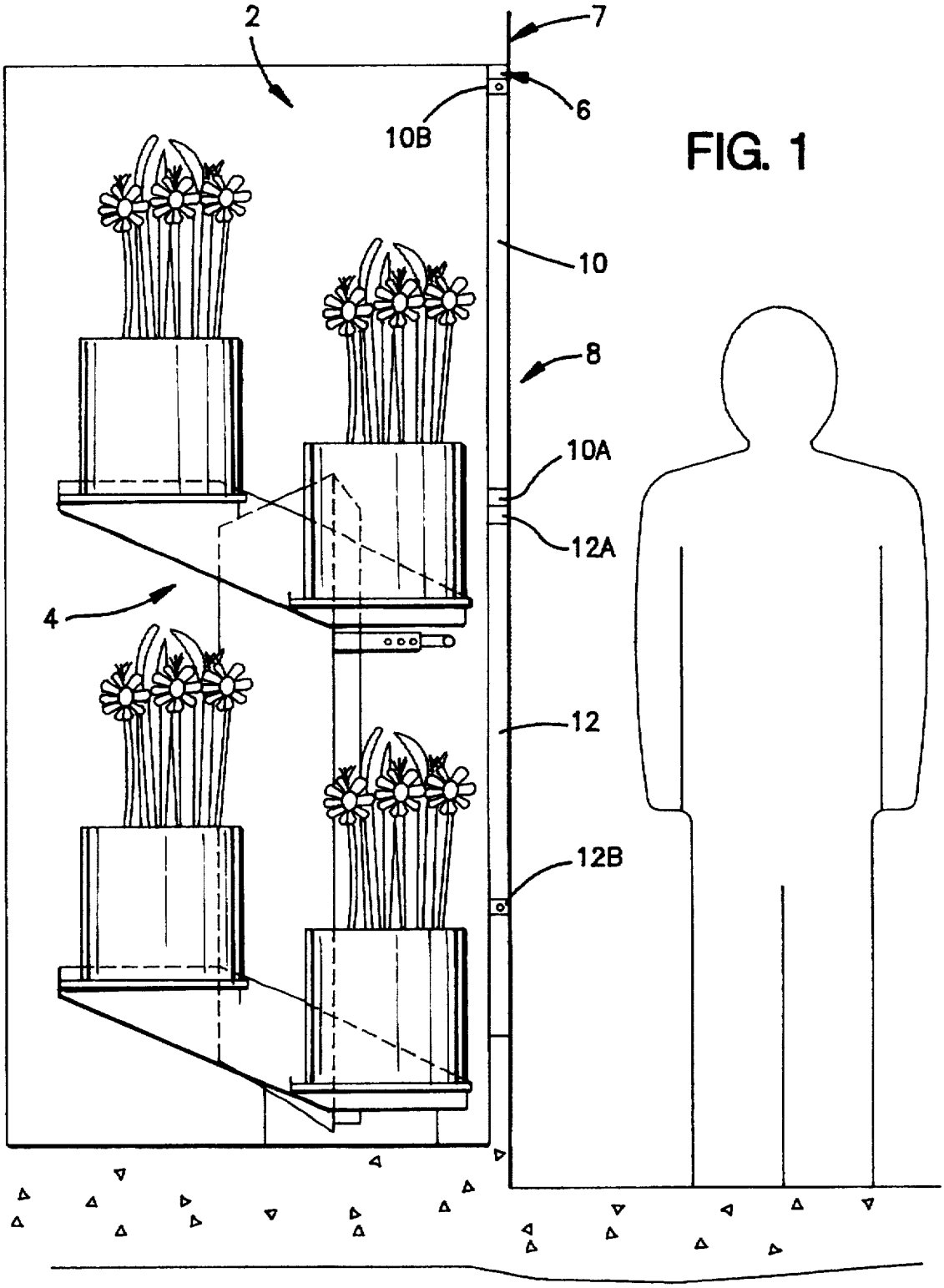
FIG. 1 is a diagrammatic view in elevation, sectioned along a vertical plane, of premises in which is arranged a display unit according to the invention in the folded-up position of confined floor space.
Figure 2:
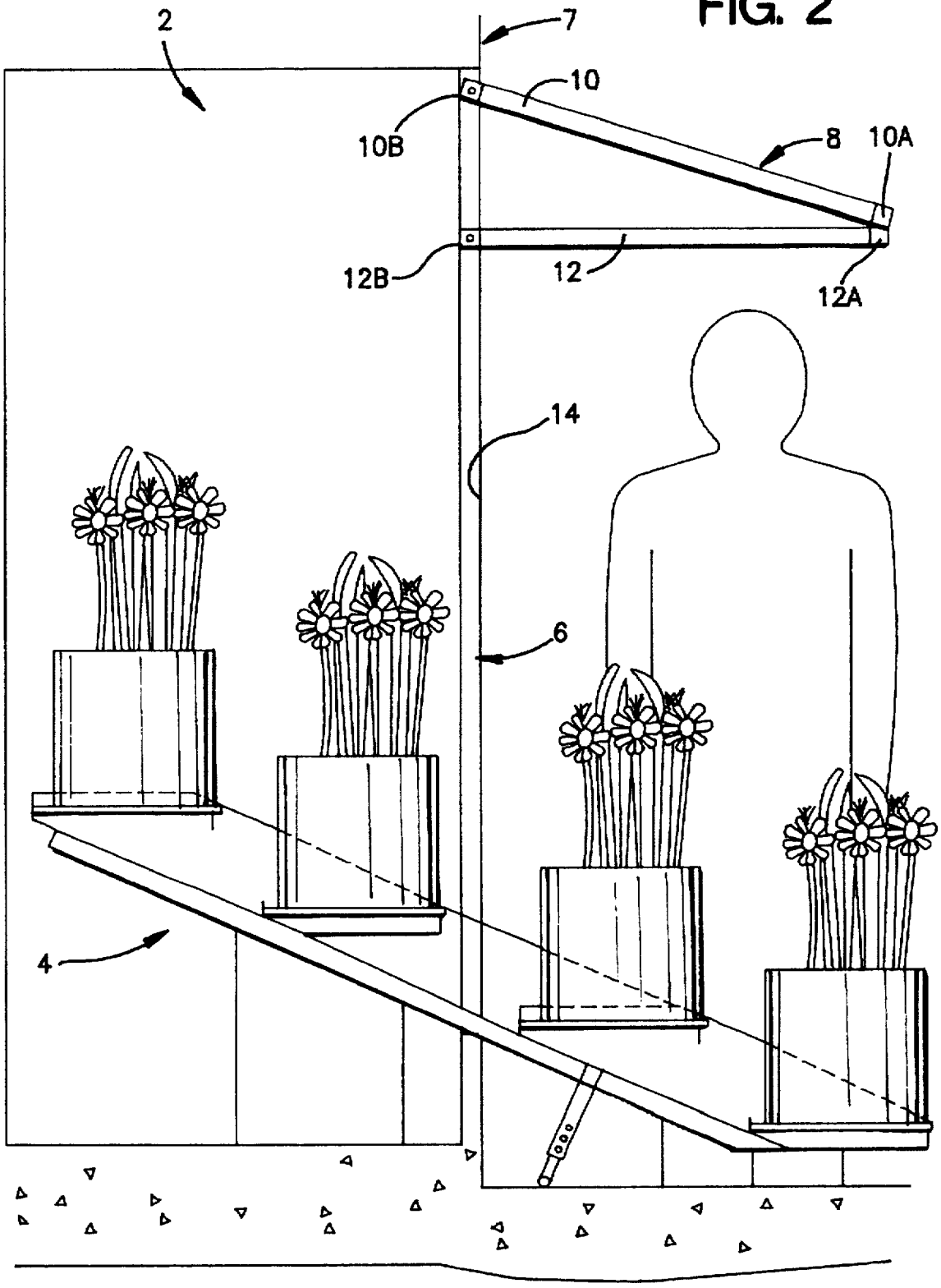
FIG. 2 is a view similar to FIG. 1 in which the display unit is in the outstretched display position after opening the retractable window.

Represented in FIGS. 1 and 2 are shop premises 2 selling for example flowers, and in which is arranged a display unit 4 according to the invention.

The premises 2 include an opening 6 of generally rectangular shape, made in a substantially vertical frontage 7, intended to be closed by a retractable window 8.

The window 8 includes two panes 10, 12, of generally rectangular shape, whose adjacent edges 10A, 12A are articulated together about a horizontal axis, and whose opposite edges 10B, 12B are located in the plane of the opening 6, the edge 10B of the upper pane 10 being articulated about a horizontal fixed axis, in the vicinity of the upper edge of the opening 6, and the edge 12B of the lower pane 12 being vertically translatable in glideways 14 secured to the edges of the opening 6.

In this way, the window 8 can be folded down so as to close the opening 6, as in represented in FIG. 1, or alternatively folded up, so as to form a canopy in the upper part of the opening 6, as is represented in FIG. 2.

The folding up and folding down of the window 8 are performed by manual or motorized means of conventional type.

When the opening 6 of the premises is shut off by the window 8, the display unit 4 is in a folded-up position such that its floor space is confined while still displaying the goods commercially.

When the window 8 is folded up, so as to expose the opening 6, the display unit 4 extends through the opening 6, in an outstretched position suitable for displaying merchandise.

A display unit 4 according to a first embodiment of the invention will now be described in more detail in conjunction with FIGS. 3 to 8.

Figure 3:
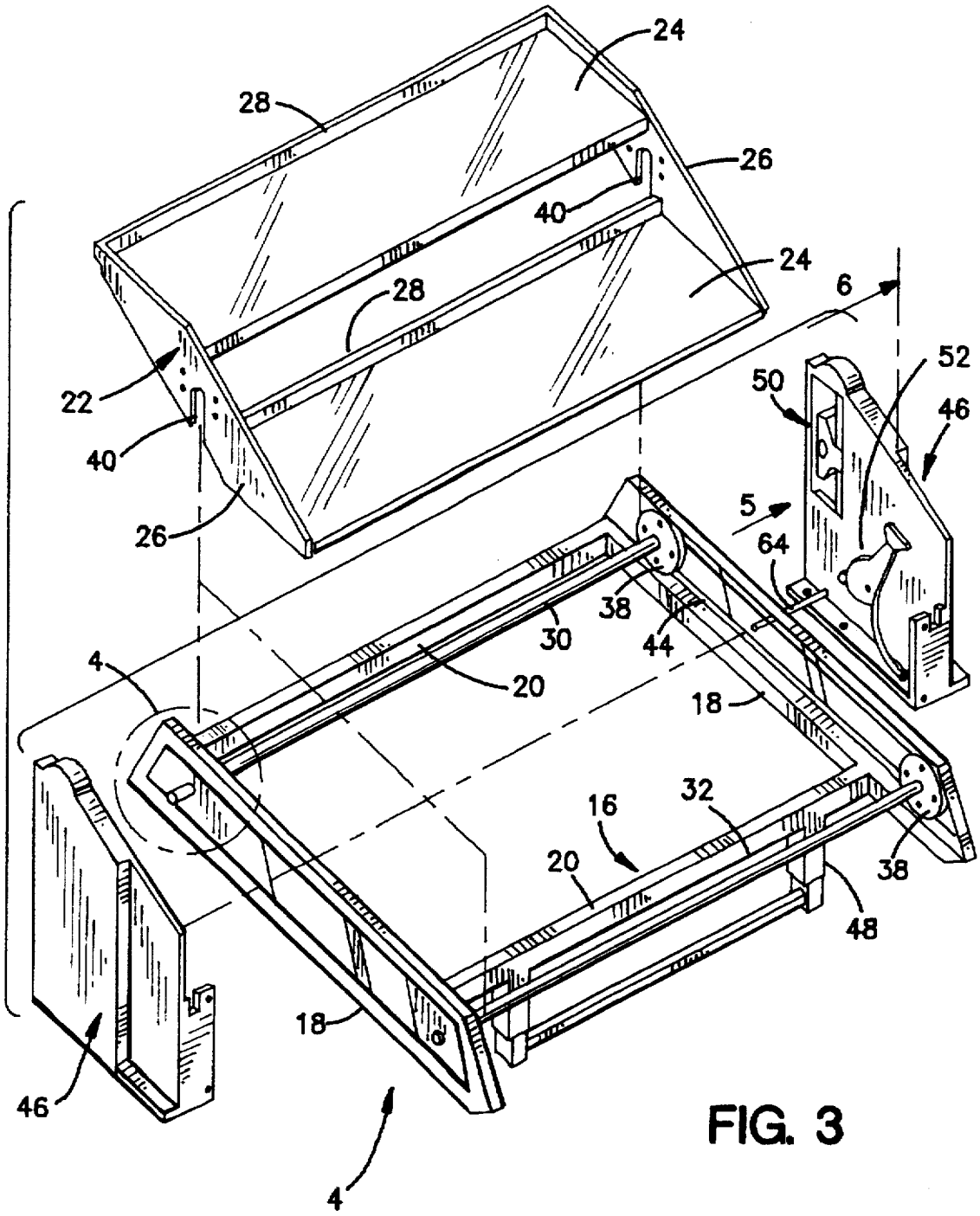
FIG. 3 is an exploded perspective view of a display unit according to a first embodiment of the invention.

Referring more particularly to FIG. 3, the display unit 4 may be seen to include a main chassis 16 including two lateral uprights 18 connected by two crosspieces 20, these elements being manufactured for example with metal angle bars and/or flat irons welded between them.

The display unit 4 moreover includes two secondary chassis 22, of which one alone is represented in FIG. 3, forming supports for shelves 24 which are horizontal or, as a variant, sloping with respect to a horizontal plane while being mutually parallel. These shelves 24 are manufactured, for example, from metal grating, laminated fibreboard, sandground laminated is glass, etc. and are intended for displaying various merchandise.

The secondary chassis 22 include uprights 26, parallel to those of the main chassis 16, in the form of plates, for example sheet metal, connected together by crosspieces 28, in the form of members, made of metal for example, delimiting bearing edges for the shelves 24.

Each secondary chamois 22 includes at least one shelf 24, preferably two shelves, as in the example described, mutually offset vertically and horizontally.

The secondary chassis 22 are each intended to be carried by a corresponding horizontal spindle 30, 32 fitted pivoting about its axis to the two uprights 18 of the main chassis 16.

Figure 4:
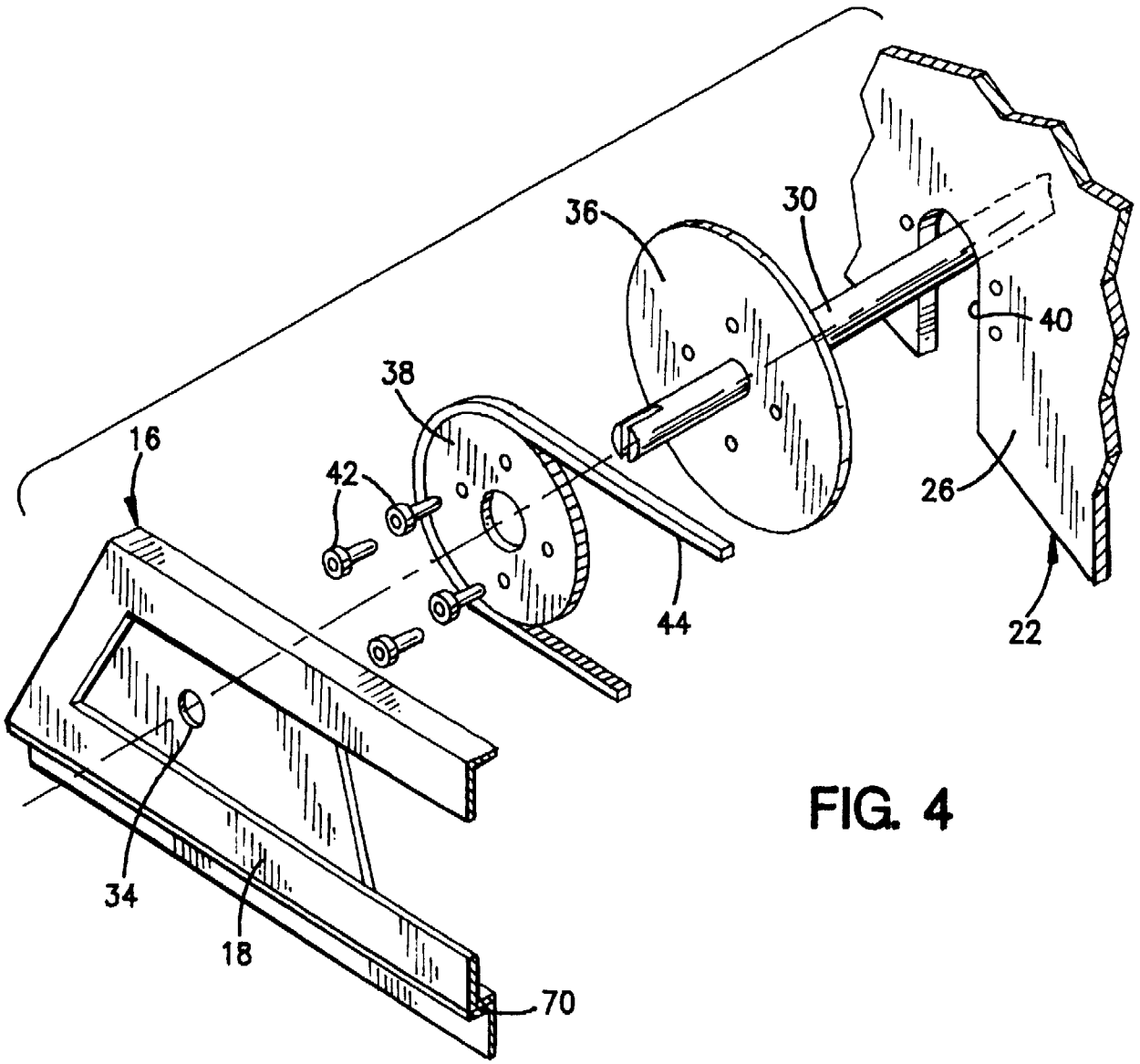
FIG. 4 is an exploded perspective detail view of the circled part 4 of FIG. 3.

As represented in FIG. 4, which shows the particular case of the spindle 30, the ends of the spindles 30, 32 swivel in bearings 34 made in the uprights 18 of the main chassis.

Each of the ends of a spindle 30, 32 includes a circular flange 36 and a toothed wheel 38 which are centered on the axis of this spindle and are fixed by known means to the latter.

The uprights 26 of each secondary chassis 22 include recesses 40 for positioning on the corresponding spindle 30, 32 and are intended to be fixed to the flanges 36 by known means.

In the example described, the flanges 36 are fixed to the spindles 30, 32 by welding, the toothed wheels 38 and the uprights 26 of the secondary chassis being fixed to the flanges 36 by screws 42.

The two toothed wheels 38 located in proximity to each upright 18 of the main chassis are coupled together by a chain 44.

The chains 44 and the wheels 38 enable the shelves 24 to be angularly stabilized as will be described subsequently.

Referring again to FIG. 3, the spindle 30 is seen to be connected to two lateral fixed frames 46, located on either side of the uprights of the main chassis, so as to form a shaft for articulating the main chassis around the horizontal axis of this shaft.

Also represented in FIG. 3 is a bearing leg 48 of the main chassis, of adjustable height, secured to the crosspiece 20 opposite the articulation shaft 30 of this chassis.

Figure 6:
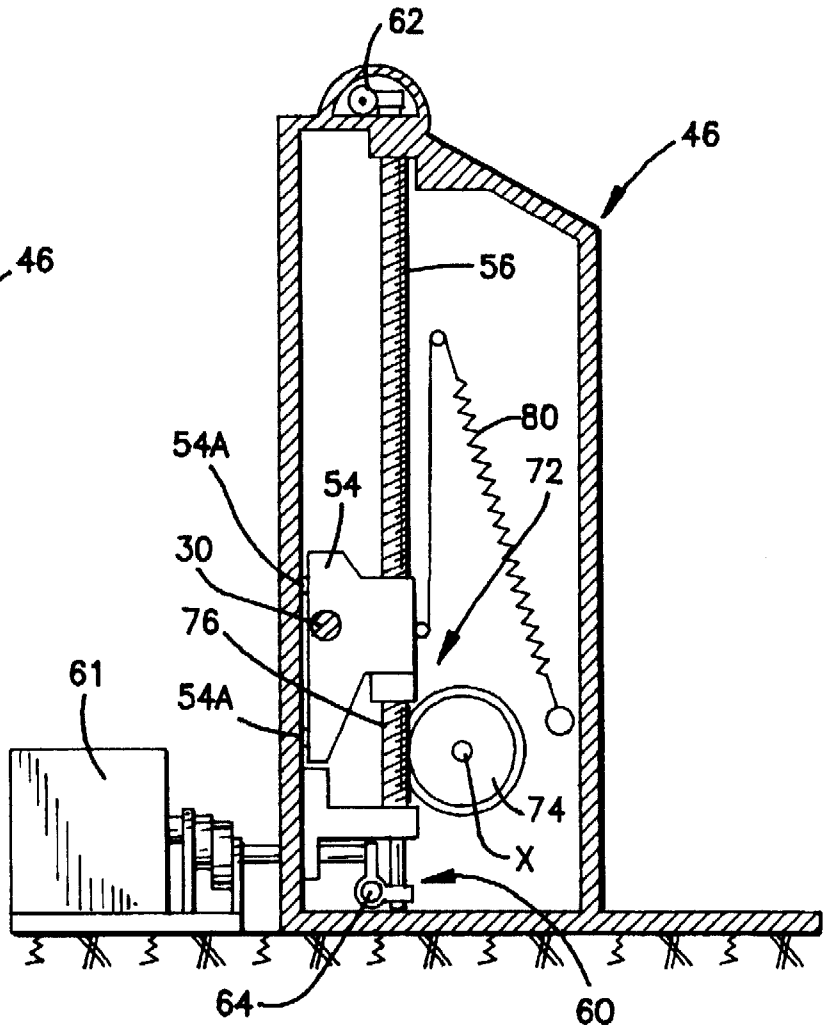
FIG. 6 is a sectional view along the line 6 of FIG. 3 of the lateral frame of FIG. 5.
Figure 5:
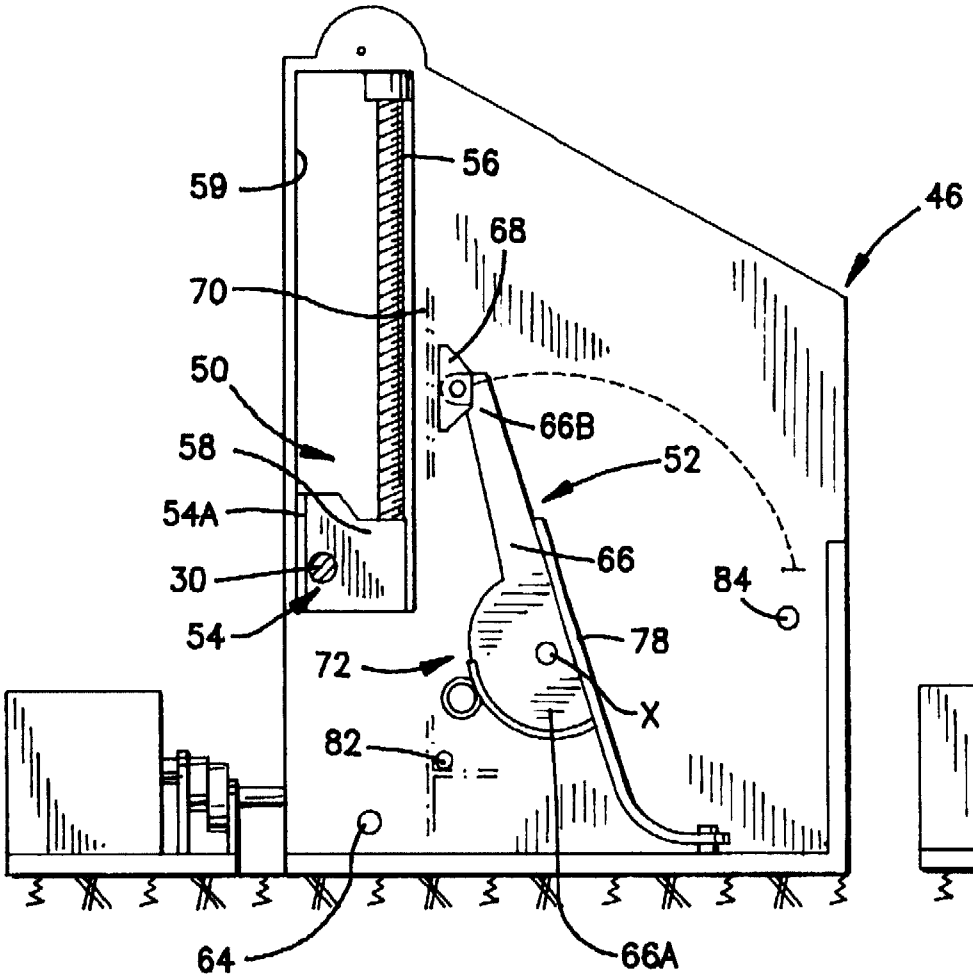
FIG. 5 is a view along the arrow 5 of FIG. 3 of a fixed lateral frame of the display unit.

The frames 46 will now be described in more detail in conjunction with FIGS. 5 and 6 representing one of these frames.

Figure 7:
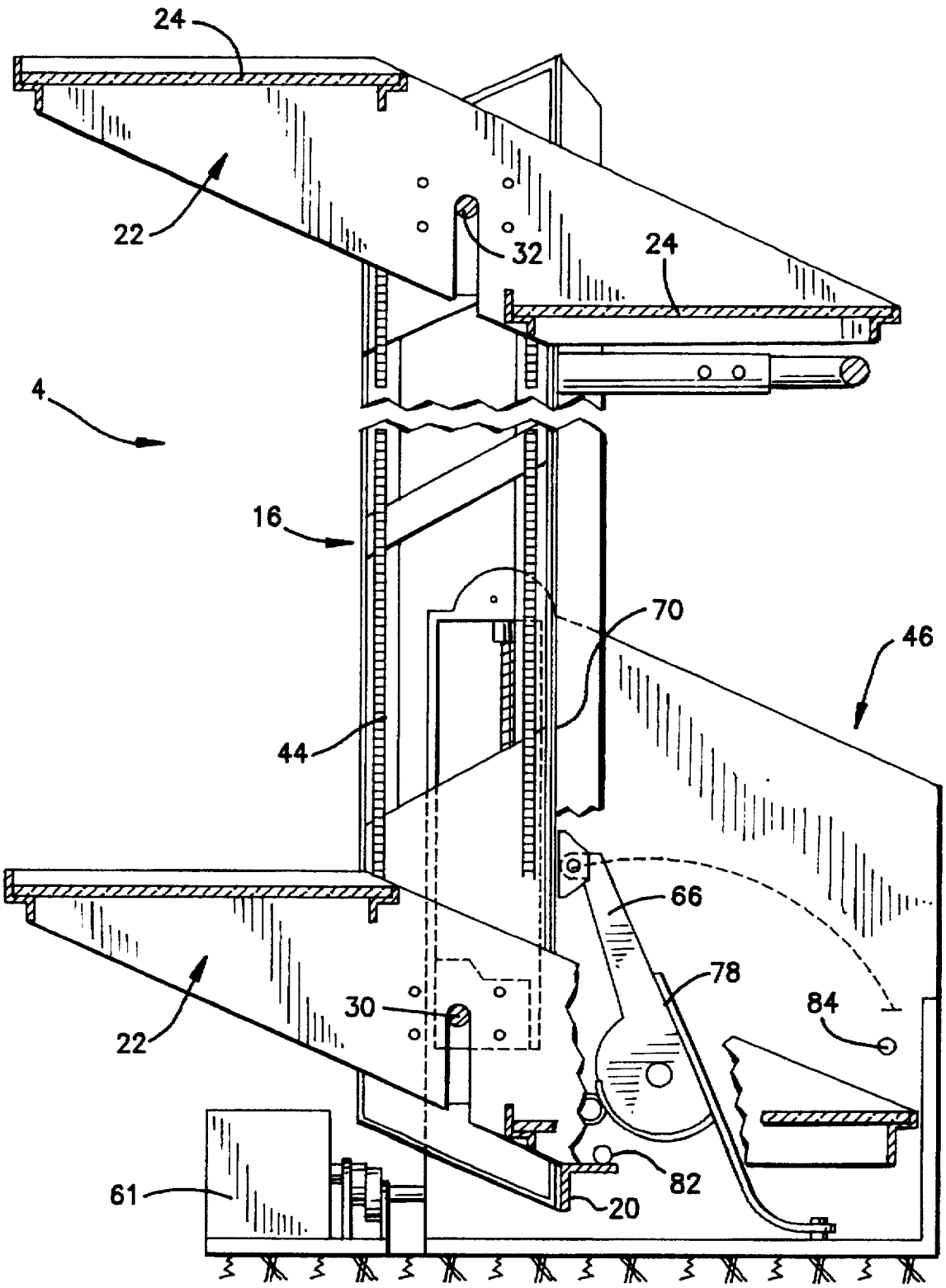
FIG. 7 is a view in elevation, sectioned along a vertical plane, and cut away, of the display unit of FIG. 3 in the folded-up position of confined space.
Figure 8:
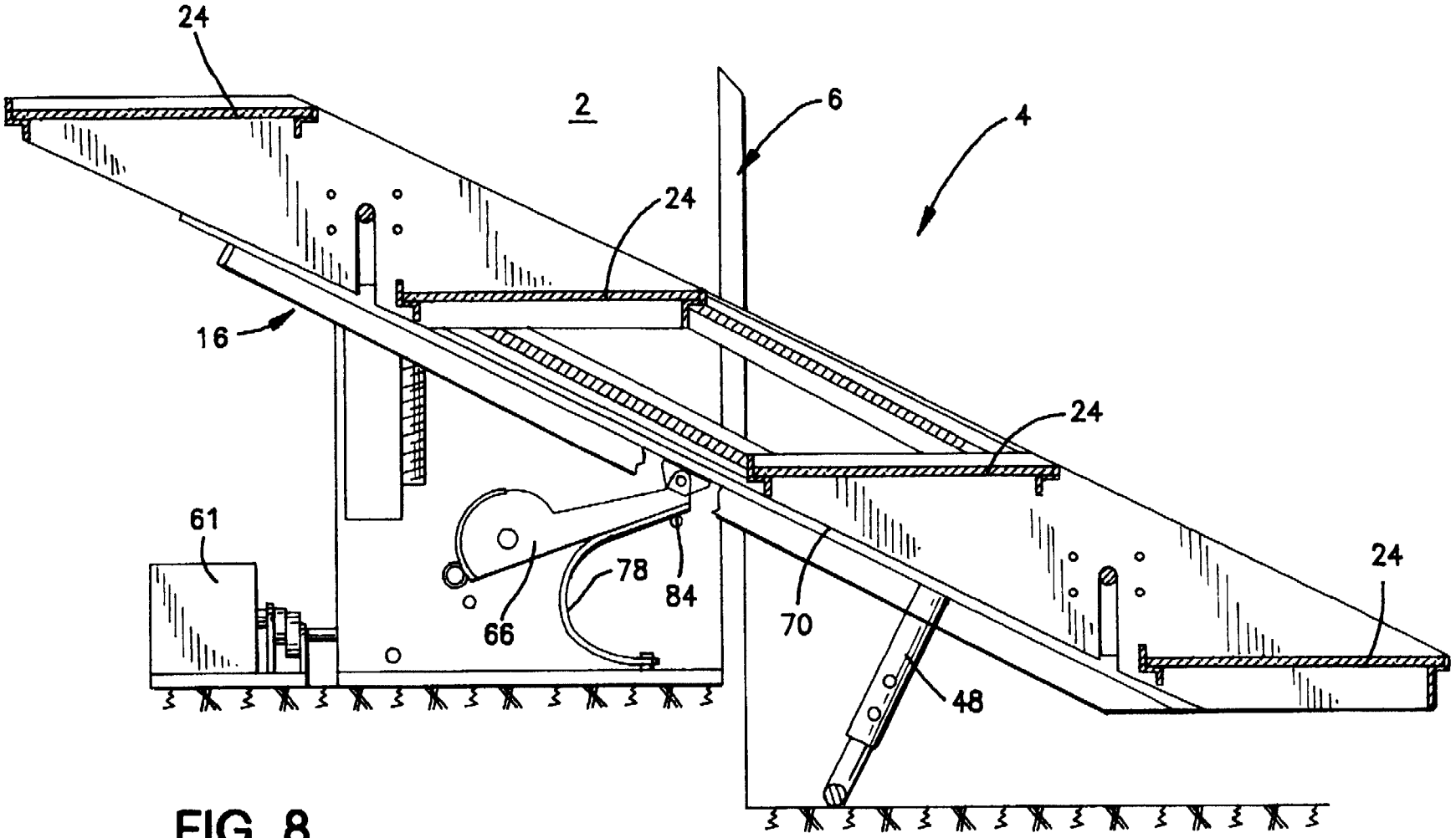
FIG. 8 is a view similar to FIG. 7 in which the display unit is in the outstretched display position.

The frames 46 include means for moving the main chassis 16 between a position of confined floor space, such as represented in FIGS. 1 and 7, in which the main chassis 16 in substantially vertical, and a display position such as that represented in FIGS. 2 and 8.

The means for the movement of the main chassis comprise means 50 for the vertical movement of the articulation shaft 30 and means 52 for swinging the main chassis 16 about this articulation shaft 30, the means 50 for vertical movement and the means 52 for swinging being coupled together.

The means 50 for vertical movement comprise two sliders 54, each of them being fixed to one of the ends of the articulation shaft 30 and being fitted into a corresponding frame 46 whilst being vertically translatable by means of a vertical threaded drive rod 56 cooperating by screwing with an end 58 forming a nut of the slider 54.

Preferably, each slider 54 includes rollers 54A cooperating with a vertical glideway 59 carried by the corresponding frame 46.

Represented in FIG. 6 are gearing means 60, of known type, intended for coupling the threaded rod 56 of the frame 46, represented in this figure with a motor 61.

Also represented in this figure are gearing means 62, of known type, intended for coupling the threaded rod 56 with conventional manual drive means, as well as gearing means including a shaft 64 for coupling the threaded rod 56 of the frame 46 represented in the figure with the threaded rod of the opposite frame.

The articulation shaft 30, secured to the sliders 54 which can only be translated vertically, is rotationally immobilized with respect to its axis, so that the spindle 32, coupled with the articulation shaft 30 by the chains 44 gearing with the toothed wheels 38, is likewise rotationally immobilized with respect to its axis. Consequently, the angular positions of the shelves 24 are preserved independently of the motions of the main chassis 16.

As a variant, the toothed wheels 38 coupled together by the chains 44 may be replaced by grooved wheels forming pulleys, coupled together by belts.

The means 52 for swinging the main chassis 16 comprise two swing arms 66, each of them being carried by the corresponding frame 46.

Each swing arm 66 includes a first end 66A fitted pivoting to the frame 46 about an axis X parallel to the articulation shaft 30, and a second end 66B, furnished with an articulated pad with rollers 68, sliding over a member 70, forming a glideway, secured to a corresponding upright 18 of the main chassis.

This member 70 is represented with broken lines in FIG. 5 and with solid lines especially in FIGS. 4, 7 and 8.

The arm 66 is coupled with the threaded rod 56, and consequently with the motor 61, by way of gearing means 72, of known type, including a toothed wheel 74 gearing with an endless screw 76 arranged on the threaded rod 56.

Each frame 46 also includes a spring leaf 78, intended to oppose the effects of the weight of the main chassis 16 and of its loading during its movements, and a tension spring 80 intended to assist the movement of the articulation shaft 30 towards its topmost position.

The spring leaf 78 includes a first end fixed to the frame 46 and a second end sliding along the swing arm 66 whilst being pressed elastically against the latter.

The tension spring 80 includes a first end fixed to the frame and a second end connected to the slider 54.

The operation of the display unit 4 according to the first embodiment of the invention will now be described in conjunction with FIGS. 7 and 8.

Initially, the window 8 is in the closed position and the main chassis 16 of the display unit 4 is in a substantially vertical position making it possible to confine the floor space of the display unit 4, as is represented in FIG. 7.

The main chassis 16 is immobilized in this vertical position by the swing arms 66 which are immobilized bearing against the glideways 70 of the main chassis and by stops 82, secured to the frames 46, cooperating with that crosspiece 20 of the main chassis which is closest to the articulation shaft 30.

In the position of the display unit 4 represented in FIG. 7, the secondary chassis 22 are located one above the other, so that merchandise placed on the shelves 24 can be seen from outside the premises, through the window 8.

In order to move the display unit 4 towards its outstretched display position such as that represented in FIG. 8, after opening the window 8, either the motor 61 is operated with the aid of known means, or the manual drive means 62 are operated in such a way as to simultaneously cause the articulation shaft 30 to rise vertically and the main chassis 16 to swing about this articulation shaft, under the effect of the vertical translation of the sliders 54 and of the pivoting of the swing arms 66 in the clockwise direction when looking at FIGS. 7 and 8.

Of course, the means for coupling the threaded rods 56 for driving the sliders 54 and the swing arms 66 are dimensioned in such a way as to synchronize the motions of these elements.

When the main chassis 16 moves towards its display position, it swings under the effect of its own weight about the articulation shaft 30, the swing arms 66 in this case having the function of opposing the weight of the main chassis 16 and thus of controlling its swing.

It will be noted that the initial direction of swing of the main chassis 16 is imposed by the stops 82 cooperating with the crosspiece 20 of this chassis.

Moreover, the lifting of the articulation shaft 30 is initially assisted by the tension springs 80.

The travel of the swing arms 66 is limited by stops 84, secured to the frames 46, cooperating with these arms 66 when the chassis is in its display position such as represented in FIG. 8.

In this position, the main chassis 16 bears on the floor, outside the premises 2, by way of the adjustable leg 48. Moreover, the shelves 24 are laid out in tiers in a manner suitable for exhibiting merchandise, two upper shelves 24 being located inside the premises 2 and two lower shelves 24 being located outside these premises.

By dimensioning the window 8 appropriately, it is possible to reclose it while the display unit 4 is in the outstretched position so that the closed window 8 separates the inside shelves from the outside shelves.

The display unit 4 is put back in place in its position represented in FIG. 7 by operating the motor 61 in a reverse fashion to that described earlier. In this case, the swing arms 66 push the main chassis 16 towards its vertical position.

It will be noted that during the movements of the main chassis 16 the effects due to the weight of this chassis have been partly countered by the spring leaves 78.

As a variant, the motor 61 can be replaced or backed-up in the event of a breakdown by manual drive means.

A second embodiment of the invention will now be described in conjunction with FIGS. 9 to 11.

In these figures, the elements analogous to those of FIGS. 1 to 8 are denoted with identical references.

Figure 9:
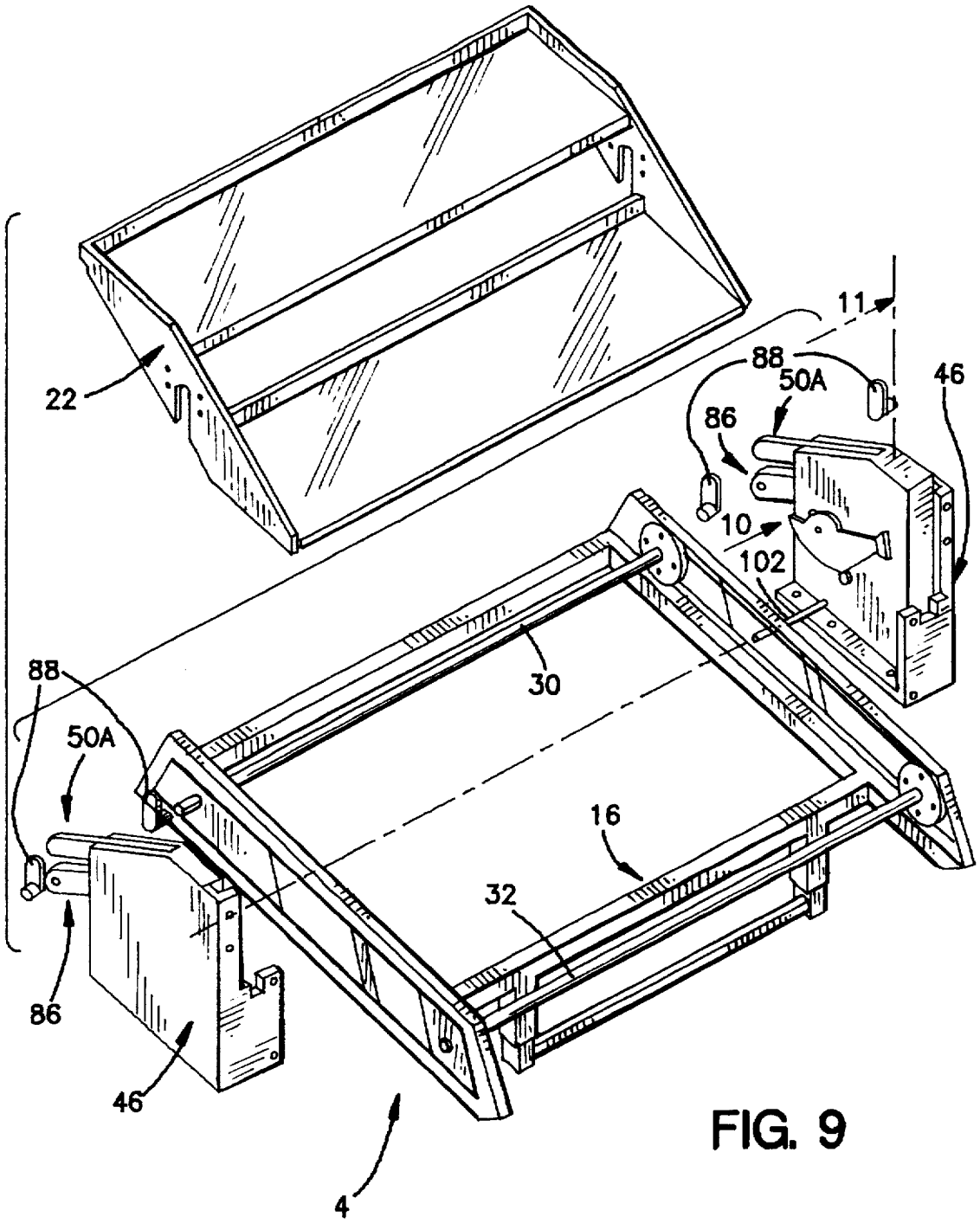
FIG. 9 is an exploded respective view of a display unit according to a second embodiment of the invention.

The display unit 4 represented in FIG. 9 differs from that described earlier in that it includes means 50A for the vertical movement of the articulation shaft 30 including two sets 86 of linkages delimiting articulated parallelograms, each of these sets 86 being carried by a frame 46.

The ends of the articulation shaft 30 are fixed to double linkages 88 delimiting vertical mobile sides of the parallelograms 86.

Figure 11:
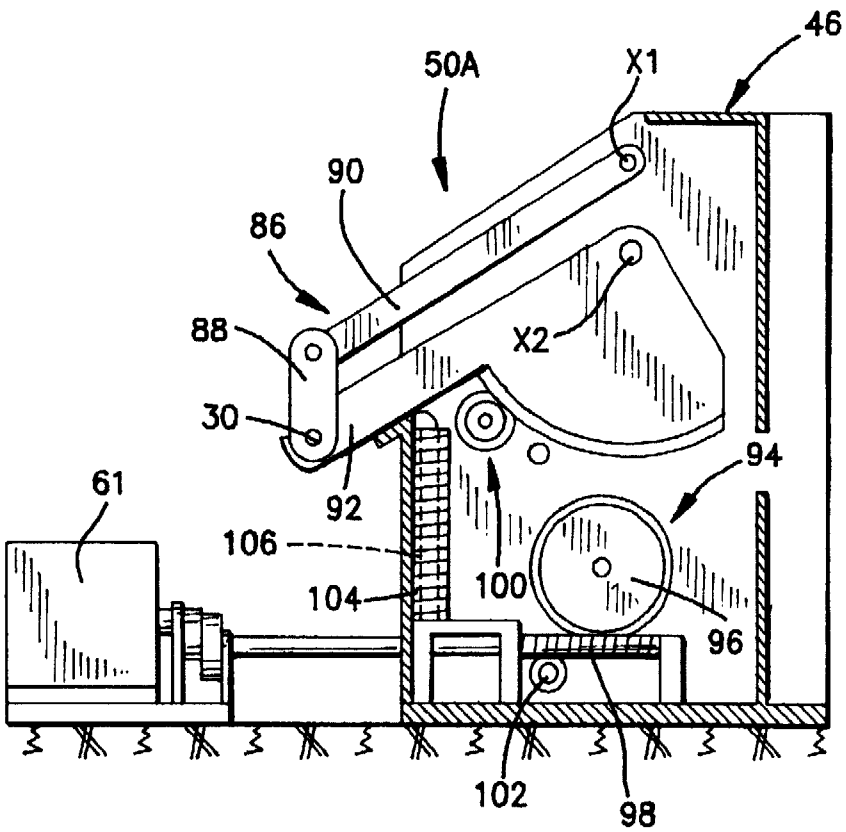
FIG. 11 is a sectional view along the line 11 of FIG. 9 of a lateral frame of the display unit.
Figure 10:
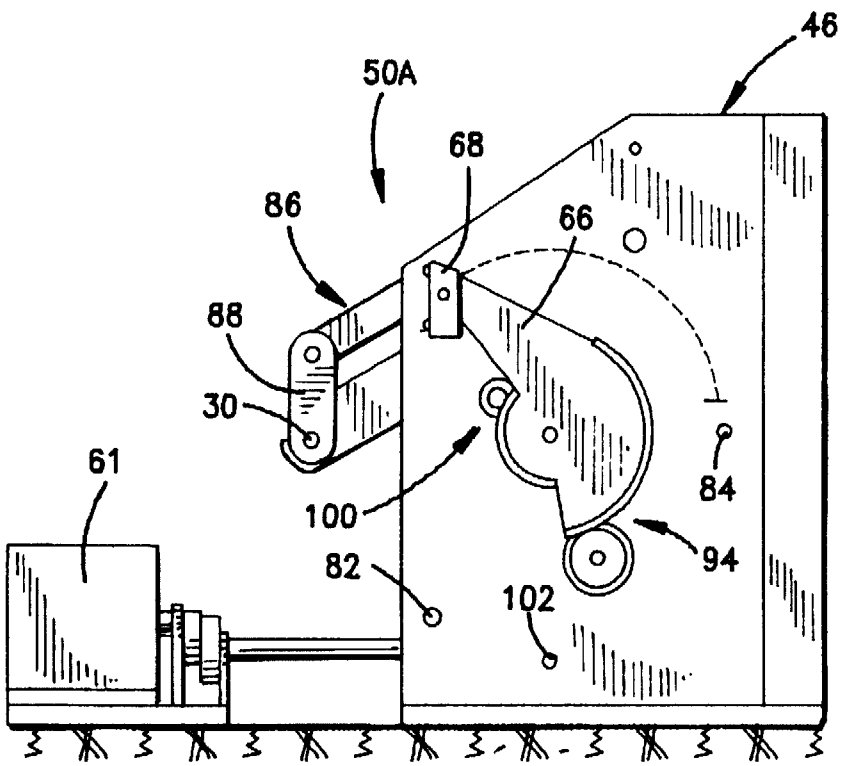
FIG. 10 is a view doing along the line 10 of FIG. 9 of a lateral frame of the display unit.

Referring in particular to FIGS. 10 and 11, the vertical side of the parallelogram 86 opposite the double linkage 88 may be seen to be fixed and to extend between two axes X1, X2, parallel to the articulation shaft 30, about which pivot two linkages 90, 92 delimiting the sides adjacent to the vertical sides of the parallelogram 86.

The swing arm 66 represented in FIGS. 10 and 11 is coupled to the motor 61 by gearing means 94, of known type, comprising in particular a toothed wheel 96 gearing with an endless screw 98 coupled with the shaft of the motor 61 (see FIG. 11).

Moreover, one of the pivoting linkages 92 is coupled with the corresponding swing arm 66 by gearing means 100 of known type.

As a variant, the two parallel sides, fixed and mobile, of the parallelogram may slope at any angle with respect to the vertical.

Also represented in FIG. 11 are means for coupling the swing arms 66 of each frame 46 including in particular a gearing shaft 102 gearing with the endless screw 98.

Each frame 46 additionally includes a compression spring 104 intended to assist the movement of the articulation shaft 30 towards its topmost position.

For this purpose, the spring 104 is threaded onto a vertical rod 106, carried by the frame 46, and includes an end in contact with the pivoting linkage 92 of the parallelogram.

The operation of the display unit 4 according to the second embodiment is analogous to that of the display unit according to the first embodiment and will therefore not be described below.

The invention includes numerous advantages.

The display unit according to the invention can be used advantageously to provide numerous shops with the rational shelving which they lack. It makes it possible to do away with the laborious manhandling of the shelves of conventional type. Additionally, it offers extremely flexible display and storage of merchandise.

When the display unit according to the invention is in the position of confined floor space for the storage of merchandise placed on the display unit, this merchandise is visible through the window of the shop, thus making it possible to hold the attention of the clientele during the periods when the shop is closed.

I claim:

1. A display unit comprising:

a main chassis having two uprights, a rotationally immobilized articulation shaft about which said main chassis is pivotable and that is fitted to said two uprights, and a rotatable horizontal spindle fitted to said two uprights;

at least one shelf pivotable about said horizontal spindle;

swinging means for pivoting said main chassis about said articulation shaft from a retracted position to a display position; and rotating means for stabilizing an angular position of said at least one shelf independently of said main chassis and for coupling said articulation shaft and said horizontal spindle.

2. The display unit according to claim 1, further comprising a further shelf affixed to said articulation shaft.

3. The display unit according to claim 1, wherein said rotating means includes at least one chain or belt for coupling two wheels, a first wheel secured to said horizontal spindle and a second wheel affixed to said articulation shaft.

4. The display unit according to claim 1, further comprising a secondary chassis pivotable about said horizontal spindle and carrying two of said shelf.

5. The display unit according to claim 1, wherein said swinging means comprise at least one swing arm with a first end pivotable about a pivot rod having an axis parallel to said articulation shaft and with a second end supporting said main chassis.

6. The display unit according to claim 1, further including elastic means for opposing effects of a weight of said main chassis and of a load on said main chassis during movement of said main chassis.

7. The display unit according to claim 6, wherein said swinging means include a fixed lateral frame located on an external side of each of said uprights, and wherein said elastic means comprise a spring leaf, located in each of the frames, each leaf spring having a first fixed end and a second end slideable along a corresponding swing arm and being urged against the corresponding swing arm.

8. The display unit according to claim 1, further comprising raising means for vertically moving said articulation shaft, said raising means being coupled to said swinging means.

9. The display unit according to claim 8, wherein said raising means comprise at least one slider hazing a nut and being secured to said articulation shaft, the nut cooperating with a threaded drive rod.

10. The display unit according to claim 9, wherein said swinging means comprise:

at least one swing arm having a first end pivotable about a pivot rod having an axis parallel to said articulation shaft, and a second end supporting said main chassis, and gearing means for coupling said swing arm to said threaded drive rod, said threaded drive rod being coupled to a drive motor or to manual drive means for manually driving said threaded drive rod.

11. The display unit according to claim 8, wherein said raising means comprise at least one set of linkages delimiting an articulated parallelogram including two first parallel sides, one side of said first parallel sides being fixed and a second side of said first parallel sides being secured to said articulation shaft and being movable by a pivoting of two second parallel sides of said parallelogram.

12. The display unit according to claim 11, wherein said swinging means comprise at least one swing arm having a first end pivotable about a pivot rod having an axis parallel to said articulation shaft, and a second end supporting said main chassis, and means for coupling said at least one swing arm to a corresponding pivoting side of the parallelogram, said at least one swing arm being coupled to at least one drive motor or to manual drive means for manually driving said pivoting side of the parallelogram.

13. The display unit according to claim 11, further including tensioning means for urging said articulation shaft towards a topmost position in said raising means.

14. The display unit according to claim 13, wherein said swinging means comprise at least one swing arm having a first end, pivotable about a pivot rod having an axis parallel to said articulation shaft, and a second end supporting said main chassis, at least one threaded drive rod cooperating with a slider having a nut, said slider being secured to a corresponding end of the articulation shaft, and gearing means for coupling said at least one swing arm and a corresponding threaded drive rod, said corresponding threaded drive rod being coupled to at least one drive motor or to manual drive means for manually driving the threaded drive rods, wherein said tensioning means comprise a tension spring having an end connected to the corresponding slider.

15. The display unit according to claim 13, wherein said swinging means comprise at least one swing arm having a first end pivotable about a pivot rod having an axis parallel to said articulation shaft, and a second end supporting the main chassis, and means for coupling said at least one swing arm and a pivoting side of a corresponding parallelogram, said at least one swing arm being coupled to at least one drive motor or to manual drive means for driving the pivoting side, wherein said tensioning means comprise a compression spring having an end cooperating with the pivoting side of the corresponding parallelogram.

16. A display unit comprising:

a main chassis, pivotable about a horizontal rotationally immobilized articulation shaft, and having two uprights and a horizontal spindle pivotably fitted to said uprights;

at least one shelf pivotable about said horizontal spindle;

swinging means for swinging said main chassis about said articulation shaft to move said main chassis between a retracted position and a display position;

rotating means for stabilizing an angular position of said at least one shelf independently of a position of said main chassis; and a display area having a substantially vertical opening closable by a retractable window, wherein said display unit is inside said display area when said main chassis is in the retracted position, and is at least partly outside said display area when said main chassis is in the display position, wherein said retractable window comprises two generally rectangular panes, of which adjacent edges are pivotable about a horizontal axis and of which opposite edges are located in a plane of said opening so that one of said opposite edges is pivotable about a fixed axis in a vicinity of an upper edge of said opening, and the other of said opposite edges is movable vertically with respect to said fixed axis.

* * * * *